US010053338B1

(12) United States Patent
Khachaturian

(10) Patent No.: US 10,053,338 B1
(45) Date of Patent: Aug. 21, 2018

(54) ADJUSTABLE SPREADER BAR

(71) Applicant: VERSABAR, INC., Houston, TX (US)

(72) Inventor: Matthew Khachaturian, New Orleans, LA (US)

(73) Assignee: VERSABAR, INC., Houston, TX (US)

( * ) Notice: Subject to any disclaimer, the term of this patent is extended or adjusted under 35 U.S.C. 154(b) by 0 days.

(21) Appl. No.: 15/591,472

(22) Filed: May 10, 2017

Related U.S. Application Data

(60) Provisional application No. 62/334,358, filed on May 10, 2016.

(51) Int. Cl.
*B66C 1/12* (2006.01)
*B66C 1/66* (2006.01)

(52) U.S. Cl.
CPC ..... *B66C 1/122* (2013.01); *B66C 1/66* (2013.01)

(58) Field of Classification Search
CPC .. B66C 1/12; B66C 1/24; B66C 1/122; B66C 1/66; F16L 37/252; F16L 39/005; F16L 21/022; F16B 7/0413
See application file for complete search history.

(56) References Cited

U.S. PATENT DOCUMENTS 3,021,166 A * 2/1962 Kempel ..... B66C 1/20 280/762
3,502,364 A * 3/1970 Moore ..... B66C 1/16 294/67.1
3,972,501 A 8/1976 Plough
4,188,168 A 2/1980 Brown et al.
4,248,472 A 2/1981 Brown et al.
4,324,023 A 4/1982 Prete, Jr.
4,352,516 A 10/1982 Gasper
4,397,493 A 8/1983 Khachaturian et al.
4,486,120 A 12/1984 Landry, Jr.
4,538,849 A 9/1985 Khachaturian et al.
4,925,080 A 5/1990 Crouse et al.
5,163,726 A 11/1992 Boos et al.
5,343,641 A 9/1994 Gregory
D391,706 S * 3/1998 Malcolm ..... 211/205
5,863,085 A 1/1999 Khachaturian
6,062,620 A 5/2000 Walker et al.
6,079,760 A 6/2000 Khachaturian
6,113,026 A 9/2000 Pottorff
(Continued)

*Primary Examiner* — Stephen A Vu
(74) *Attorney, Agent, or Firm* — Garvey, Smith & Nehrbass, Patent Attorneys, L.L.C.; Charles C. Garvey, Jr.; Vanessa M. D'Souza

(57) ABSTRACT

A spreader bar apparatus provides a bar member having a bar length and first and second bar end portions. A plurality of transverse bar openings are spaced between the bar and end portions. A first bar lifting portion or link assembly is movable relative to the bar and into different positions. A second bar lifting portion or link assembly is movable relative to the bar and into different positions. Each bar lifting portion or link assembly has a trunnion sleeve fitted with multiple links. One or more lifting lines are each attachable to the lifting portions such as to an upper link or lower link. Each lifting member includes an upper link, a lower link, and a trunnion sleeve, wherein the trunnion sleeve has a bore that is sized and shaped to receive the bar, wherein the upper and lower links are rotatably mounted to the trunnion sleeve. One or more pins enable the trunnion sleeve to be attached to the bar at a selected bar opening.

28 Claims, 8 Drawing Sheets

(56) References Cited

U.S. PATENT DOCUMENTS

| | | | | |
|---|---|---|---|---|
| 6,296,288 | B1 | 10/2001 | Khachaturian | |
| 6,314,594 | B1 | 11/2001 | Meoli, Jr. et al. | |
| 6,412,649 | B1 | 7/2002 | Khachaturian | |
| 7,182,292 | B2 | 2/2007 | Howard et al. | |
| 7,222,903 | B2 * | 5/2007 | Tardiff | B66C 1/10 294/74 |
| D569,331 | S | 5/2008 | Gassew | |
| 7,399,019 | B2 | 7/2008 | Malmgren et al. | |
| 7,837,413 | B1 | 11/2010 | Kundel, Sr. | |
| 7,967,352 | B2 | 6/2011 | Di Martino | |
| 7,988,214 | B2 | 8/2011 | Grizzle | |
| 8,020,716 | B2 * | 9/2011 | Vitale | A47B 57/06 211/197 |
| 8,251,309 | B2 | 8/2012 | Sammito et al. | |
| 8,382,175 | B2 | 2/2013 | DiMartino | |
| D717,251 | S | 11/2014 | Mueller | |
| 8,955,894 | B2 | 2/2015 | Parker | |
| 9,132,993 | B1 | 9/2015 | DiMartino et al. | |
| D748,151 | S | 1/2016 | Benson | |
| 2009/0072561 | A1 * | 3/2009 | Latham | B66C 1/10 294/81.2 |

* cited by examiner

ADJUSTABLE SPREADER BAR

CROSS-REFERENCE TO RELATED APPLICATIONS

Priority to and/or the benefit of U.S. Provisional Patent Application Ser. No. 62/334,358, filed on 10 May 2016, which is hereby incorporated herein by reference, is hereby claimed.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to spreader bars, and more particularly to spreader bars that can be adjusted thus enabling connection to and lifting of objects or loads of various sizes. Even more particularly, the present invention relates to an improved spreader bar apparatus that includes a bar and lifting fittings that are movable along the bar and that can be locked or pinned at a selected locale with a special trunnion and link arrangement.

2. General Background of the Invention

Spreader bars are used to lift a heavy object (load or package) with a crane, wherein it is important to remove or reduce any horizontal load component on the object, load, or package. Some spreader bar designs have been patented. Examples of patented spreader bars can be seen in the following table, each listed patent being incorporated herein by reference.

The following U.S. Patents are incorporated herein by reference:

| Pat. No. | Title | Date of Issue |
|---|---|---|
| D748,151S | Spreader Bar | Jan. 26, 2016 |
| 9,132,993 | Load Spreader Bar Pipe Connecting Sleeve with Offset End Plate | Sep. 15, 2015 |
| 8,955,894 | Adjustable Spreader Bar System | Feb. 17, 2015 |
| D717,251S | Heat Spreader with Fins and Top Bar on a Memory Module | Nov. 11, 2014 |
| 8,382,175 | Load Spreader Bar Pipe Connection Sleeve | Feb. 26, 2013 |
| 8,251,309 | Thrust Force Take-Up Device for An Aircraft Engine Pylon Engine Mounting Structure, Comprising Lateral Link Rods with Integral Spreader Bar Stops | Aug. 28, 2012 |
| 7,988,214 | Cargo Spreader Bar | Aug. 2, 2011 |
| 7,967,352 | Load Spreader Bar End Cap | Jun. 28, 2011 |
| 7,837,413 | Adjustable Trench Box and Spreader Bar | Nov. 23, 2010 |
| 7,399,019 | Automatic Adjustable Spreader Bar | Jul. 15, 2008 |
| D569,331S | Spreader Bar Hardware | May 20, 2008 |
| 7,222,903 | Spreader Bar Apparatus | May 29, 2007 |
| 7,182,292 | Wide Spreader Bar and Lift-Up Seat Spreader Bar for Seat Legs | Feb. 27, 2007 |
| 6,412,649 | Spreader Bar Apparatus | Jul 2, 2002 |
| 6,314,594 | Spreader Bar for a Hammock | Nov. 13, 2001 |
| 6,296,288 | Spreader Bar Apparatus | Oct. 2, 2001 |
| 6,113,026 | Bow Spreader Bar | Sep. 5, 2000 |

-continued

| Pat. No. | Title | Date of Issue |
|---|---|---|
| 6,079,760 | Spreader Bar Apparatus | Jun. 27, 2000 |
| 6,062,620 | Spreader Bar | May 16, 2000 |
| 5,863,085 | Spreader Bar Assembly | Jan. 26, 1999 |
| 5,343,641 | Spreader Bar for Strip Mine Rigging Apparatus | Sep. 6, 1994 |
| 5,163,726 | Spreader Bar and Overheight Attachment with Automatic Latching Mechanism | Nov. 17, 1992 |
| 4,925,080 | Spreader Bar Apparatus | May 15, 1990 |
| 4,538,849 | Spreader Bar Assembly | Sep. 3, 1985 |
| 4,486,120 | Spreader Bar for Soil Erosion Prevention Mats | Dec. 4, 1984 |
| 4,397,493 | Spreader Bar Assembly | Aug. 9, 1983 |
| 4,352,516 | Spreader Bar | Oct. 5, 1982 |
| 4,324,023 | Ratchet Buckle Having Reinforcing Spreader Bar Insert | Apr. 13, 1982 |
| 4,248,472 | Bow and Spreader Bar | Feb. 3, 1981 |
| 4,188,168 | Bow and Spreader Bar | Feb 12, 1980 |
| 3,972,501 | Spreader Bar Assembly for a Concrete Wall Form | Aug. 3, 1976 |

BRIEF SUMMARY OF THE INVENTION

The present invention provides an adjustable spreader bar arrangement of improved construction and configuration. The apparatus includes an elongated bar to which a pair of link assemblies can be affixed. Each link assembly preferably includes a trunnion sleeve and upper and lower links, each link attached to the trunnion sleeve.

The upper and lower links are preferably attached (e.g., pivotally) to the trunnion sleeve, which moves (e.g., slides, rolls) back and forth along the bar. Once a link assembly hole is lined up with a hole or bore in the spreader bar, a pin can be inserted through the sleeve and the bar at the aligned openings/bores. The pins can be sitting in pin troughs for ease of pushing and pulling the pins into place.

The design of the present invention provides for easy length adjustability, even for large capacities while optimizing spreader bar stresses. This is accomplished by all vertical loads passing through the links so that preferably no vertical load goes through the spreader bar, and horizontal load transfers from the links to the pin going through the bar. Preferably, the bar thus only sees horizontal or compression loading.

The present invention thus provides an improved spreader bar apparatus. In one or more embodiments, the apparatus includes a bar member having a bar length, first and second bar end portions, and a plurality of stops spaced between the bar and end portions.

A first link assembly provides a first lifting portion. A second link assembly provides a second lifting portion. Each link assembly can be movable from one stop or location to another stop or location.

Multiple lifting lines can be attached to the link assemblies.

Each link assembly preferably includes an upper link, a lower link, and a trunnion sleeve, wherein the trunnion sleeve has a bore that is receptive of the bar, and wherein the upper and lower links are rotatably mounted to the trunnion sleeve.

In one embodiment, each link can be pivotal relative to the other link.

In one embodiment, a pinned connection enables a connection of each trunnion to a selected opening, location or stop.

In one embodiment, each said upper link has an opening that defines a lift line attachment.

In one embodiment, each said lower link has an opening that defines a lift line attachment.

In one embodiment, a pinned connection connects each trunnion sleeve to the bar at a selected opening or stop and connects to each said upper and lower links to the trunnion sleeve.

In one embodiment, the lower link has an opening that can be connectable to a lift line.

In one embodiment, a common pinned connection joins each lift line link member and a trunnion.

In one embodiment, the stops include spaced apart bar openings.

In one embodiment, the bar can be a hollow pipe or tube and the stops are pairs of aligned openings.

In one or more embodiments the present invention provides an improved spreader bar apparatus that provides a bar member having a bar length and first and second bar end portions and a plurality of transverse bar openings or transverse bores spaced between the bar and end portions.

A first bar lifting portion can be mounted on the bar and movable relative to the bar.

A second bar lifting portion can be mounted on the bar and movable relative to the bar.

Each bar lifting portion can be movable from one bar opening to another bar opening.

One or more lifting lines can be attachable to the lifting portions, such as to upper and lower links.

Each lifting member preferably includes an upper link, a lower link, and a trunnion sleeve, wherein the trunnion sleeve has a bore that is sized and shaped to receive of the bar, and wherein the upper and lower links are rotatably mounted to the trunnion sleeve.

One or more pins can enable the trunnion sleeve and upper and lower links to be attached to the bar at a selected bar opening.

In one embodiment, each upper link can be pivotal relative to a lower link.

In one embodiment, the pin defines a pinned connection that joins each trunnion sleeve to a selected opening.

In one embodiment, the upper link has an opening that defines a lift line attachment.

In one embodiment, the lower link has an opening that defines a lift line attachment.

In one embodiment, the pinned connection connects each trunnion to the bar at a selected opening and the pin connects to each said upper and lower link.

In one embodiment, the lower link has an opening that can be connectable to a lift line.

In one embodiment, the pin defines a common pinned connection that joins a lift line link member and a trunnion.

In one embodiment, the bar can be a hollow pipe or tube and the openings include a pair of horizontally aligned openings that are each equidistant from a said bar end portion.

In one embodiment, the openings are pairs of aligned openings.

BRIEF DESCRIPTION OF THE SEVERAL VIEWS OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figure 1:
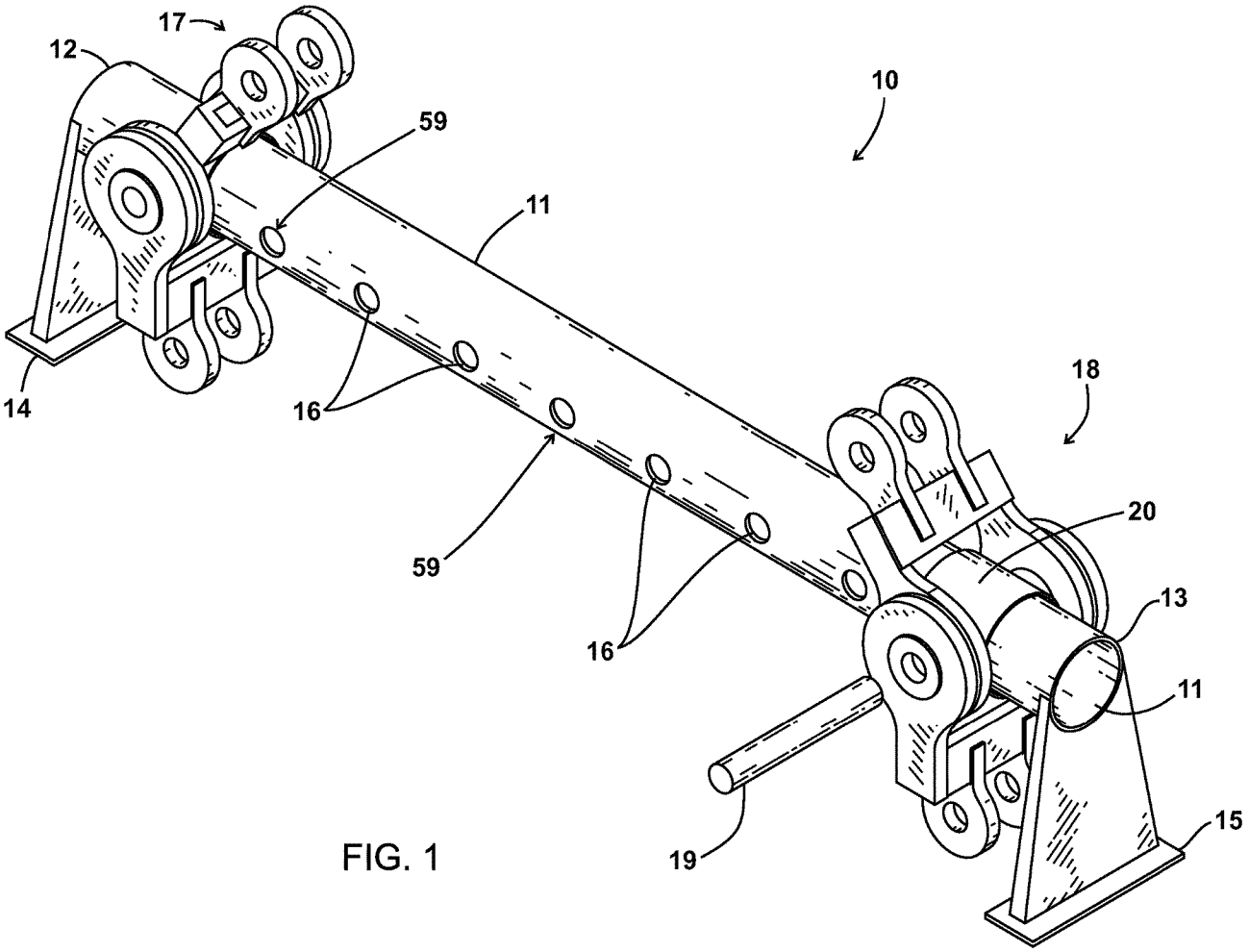
FIG. 1 is a perspective view of a preferred embodiment of the apparatus of the present invention.
Figure 7:
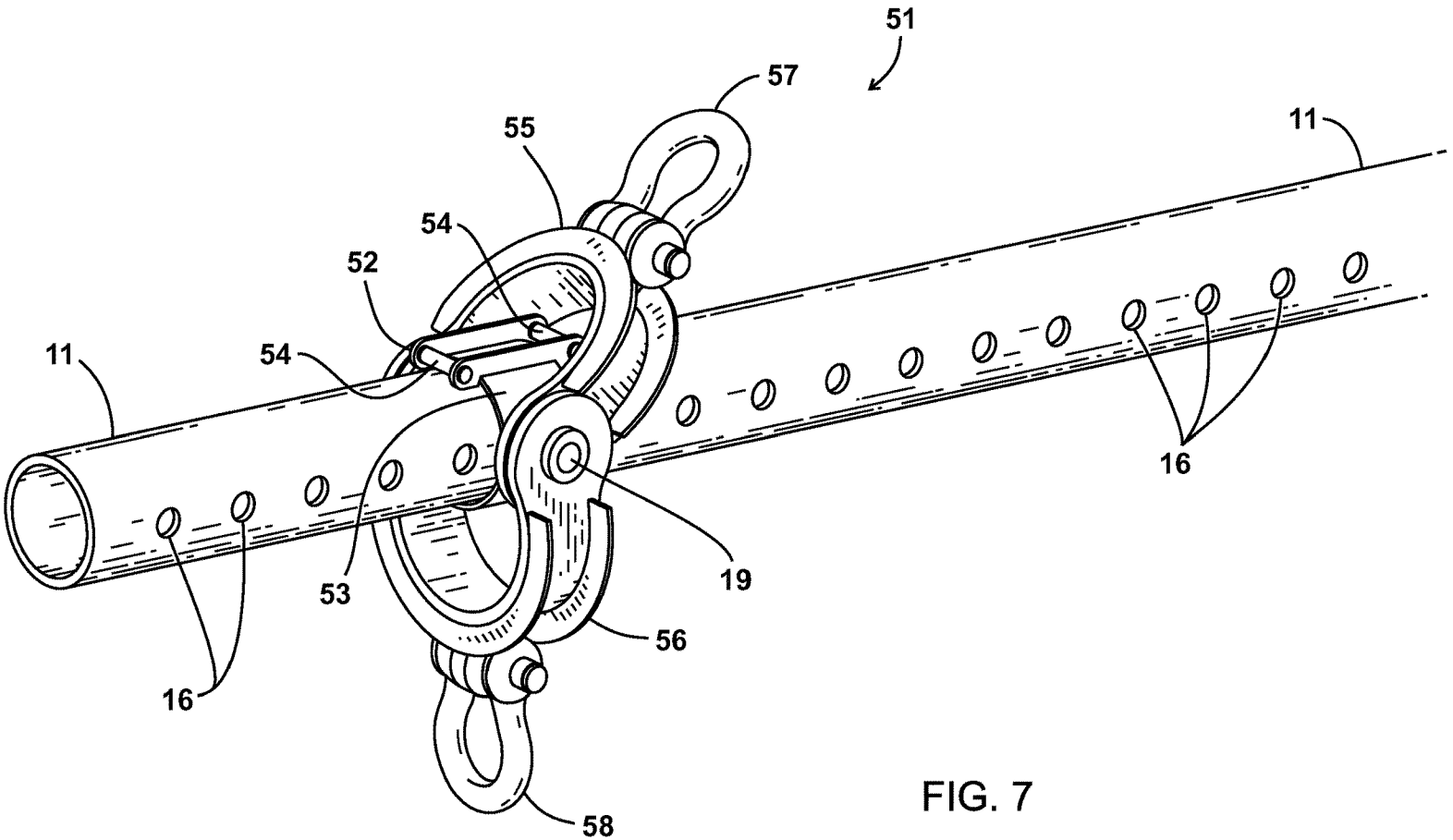
FIG. 7 is a fragmentary view showing an alternate link assembly arrangement.
Figure 8:
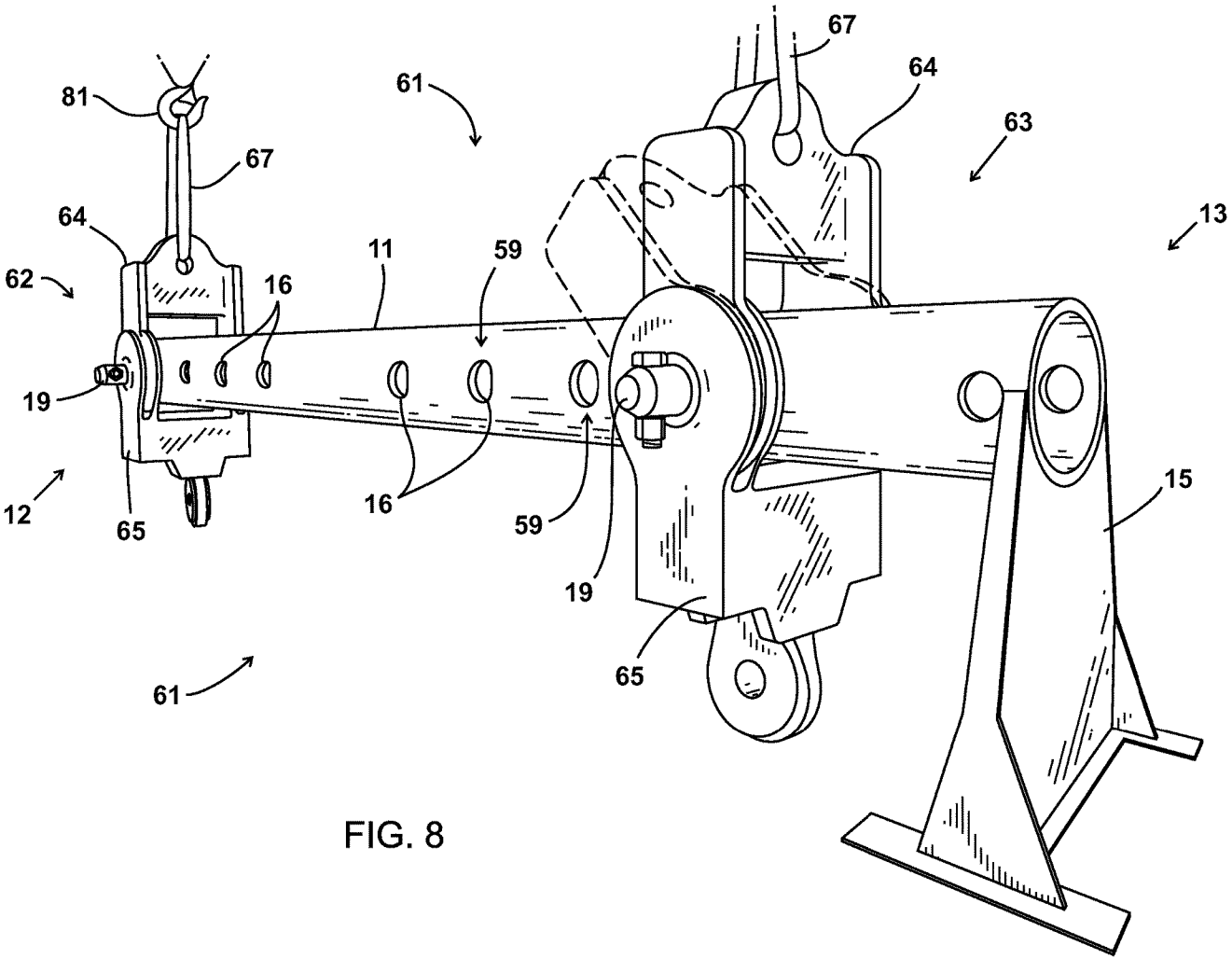
FIG. 8 is a perspective view of another alternate embodiment of the apparatus of the present invention.
Figure 10:
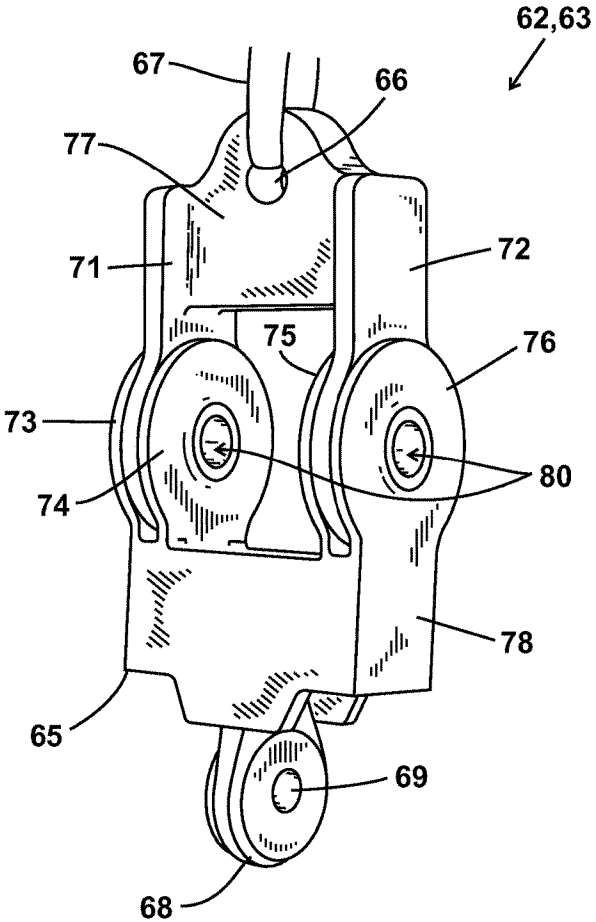
FIG. 10 is a fragmentary perspective view of the embodiment of FIG. 8.
Figure 9:
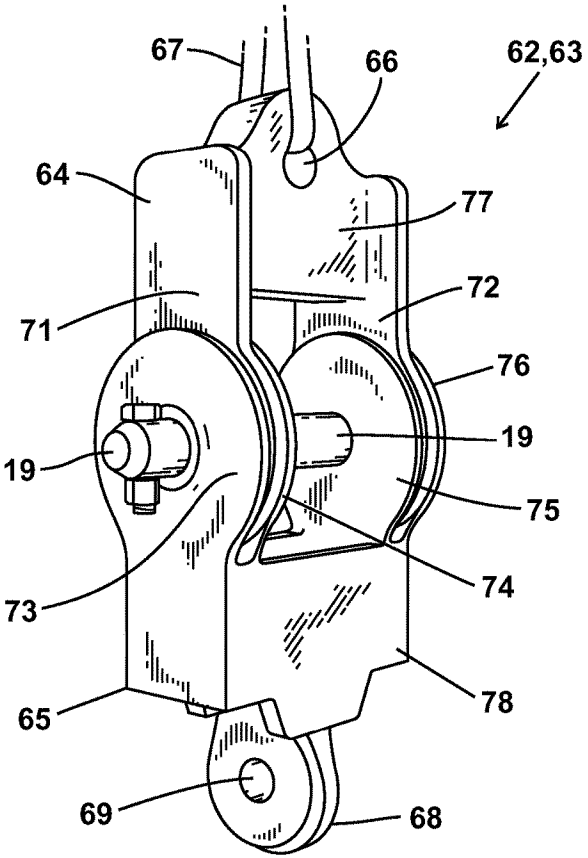
FIG. 9 is a fragmentary perspective view of the embodiment of FIG. 8.
Figure 12:
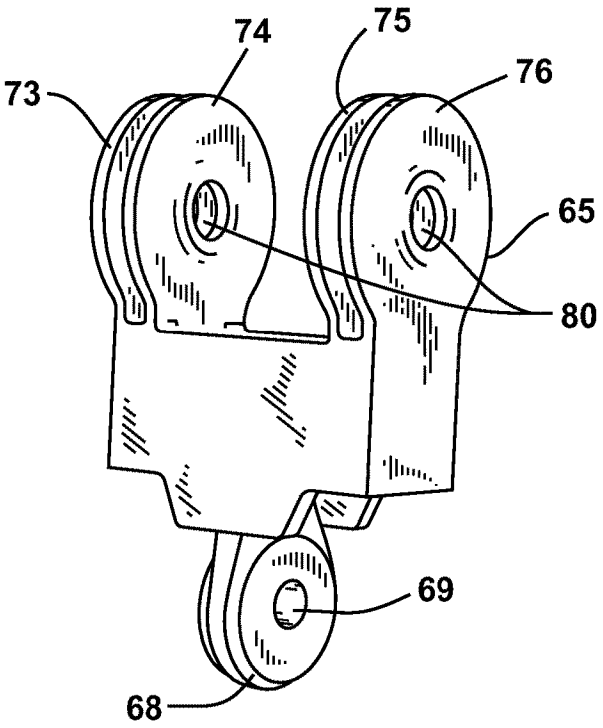
FIG. 12 is a fragmentary perspective view of the embodiment of FIG. 8.
Figure 11:
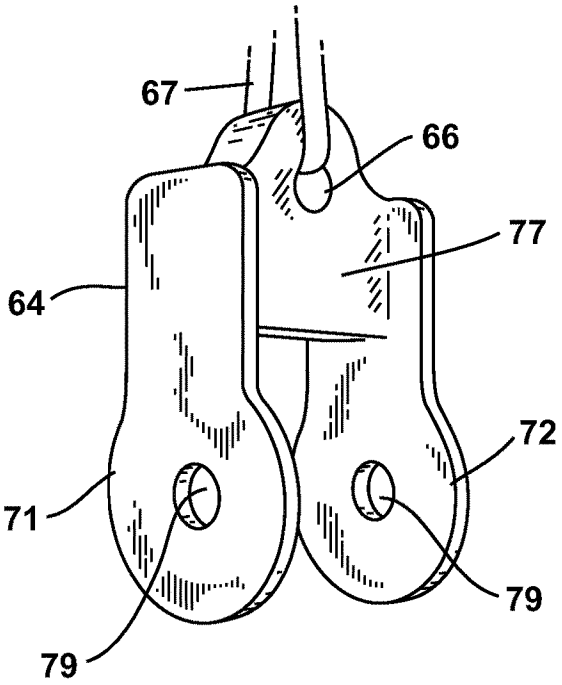
FIG. 11 is a fragmentary perspective view of the embodiment of FIG. 8.

FIGS. 1-5 show a preferred embodiment of the apparatus of the present invention designated generally by the numeral 10. Adjustable spreader bar apparatus 10 includes an elongated bar 11 having bar ends or bar end portions 12, 13. The bar end portion 12 can provide a foot 14. The bar end portion 13 can provide a foot 15. Bar 11 can be a solid bar such as a steel bar or aluminum bar. Bar 11 can be a hollow pipe or hollow tube as seen in FIGS. 1 and 7. Bar 11 can be other shapes or have other cross sections such as square tubing, for example.

There can be transverse openings or bores 16 at spaced intervals along bar 11 and at stops or locations/positions 59. Each of the openings or bores 16 preferably extends completely through bar 11 and at right angles to the bar central longitudinal axis 60 (see FIG. 6). In this fashion, a pin 19 can be inserted completely through the bar 11 by inserting the pin 19 into the bar opening or bore 16 at a select location 59. If bar 11 is a hollow pipe or hollow tube, the transverse openings 16 can be in aligned pairs of openings 16, wherein preferably one opening 16 is spaced 180 degrees apart from the other opening 16 so that the pin 19 can be inserted through the pair of openings 16 for each location or stop 59 along bar 11.

A pair of link assemblies 17, 18 are each attachable to the bar 11 at a selected position or location 59. The link assemblies include first link assembly 17 and second link assembly 18. Rollers 54 (see FIG. 7) can be provided to aid in travel of each link assembly 17, 18 along bar 11. A user can affix a selected link assembly 17 or 18 to the bar 11 at a selected location 59 by placing pin 19 through the openings or bores of a link assembly 17 or 18 when aligned with an opening or bore (or openings) 16 of the bar 11.

Figure 3:
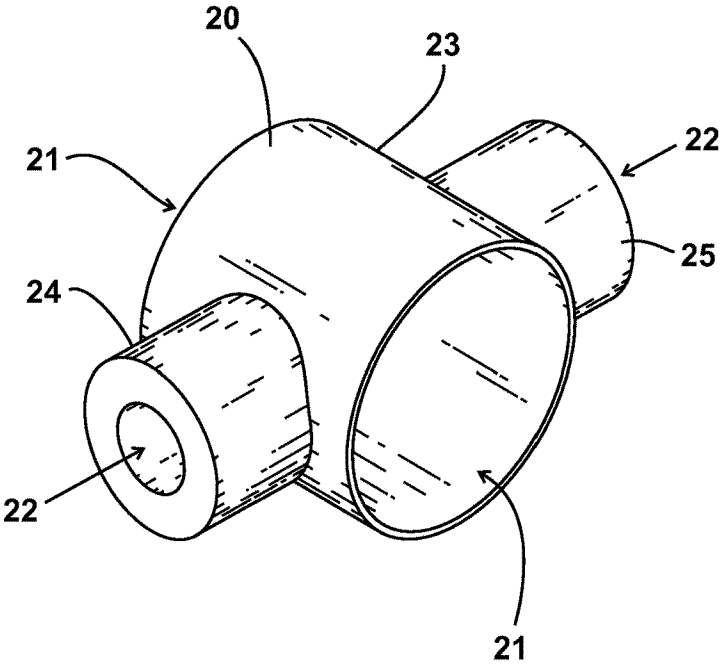
FIG. 3 is a fragmentary view of a preferred embodiment of the apparatus of the present invention showing the trunnion sleeve.
Figure 2:
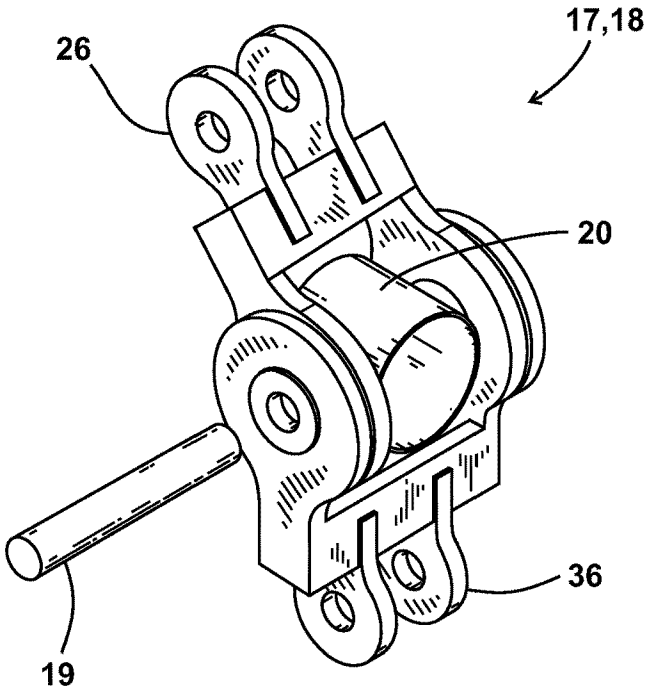
FIG. 2 is partial perspective view of a preferred embodiment of the apparatus of the present invention showing one of the link assemblies.

Each link assembly 17, 18 preferably includes a trunnion sleeve 20 as seen in FIGS. 1-3. The trunnion sleeve 20 as shown in the figure has a first open ended bore 21 and second open ended bore 22. The trunnion sleeve 20 includes a larger diameter sleeve 23 to which are attached (for example, welded) smaller diameter sleeves 24, 25. Each smaller sleeve 24, 25 has a bore 22.

The link assemblies 17, 18 each include an upper link 26 and a lower link 36. Upper link 26 (FIG. 4) includes a pair of smaller upper plates, 27, 28 and a pair of larger lower plates 31, 32. Smaller upper plate 27 has plate opening 29. Smaller upper plate 28 has plate opening 30. Larger lower plate 31 has plate opening 33. Larger lower plate 32 has plate opening 34. Each of the smaller upper plates 27, 28 and larger lower plates 31, 32 are connected using a connecting portion 35 that can include multiple structural beams and/or plates welded together. The connection of the smaller upper plates 27, 28 and larger lower plates 31, 32 to connecting portion 35 can be a welded connection.

Figure 5:
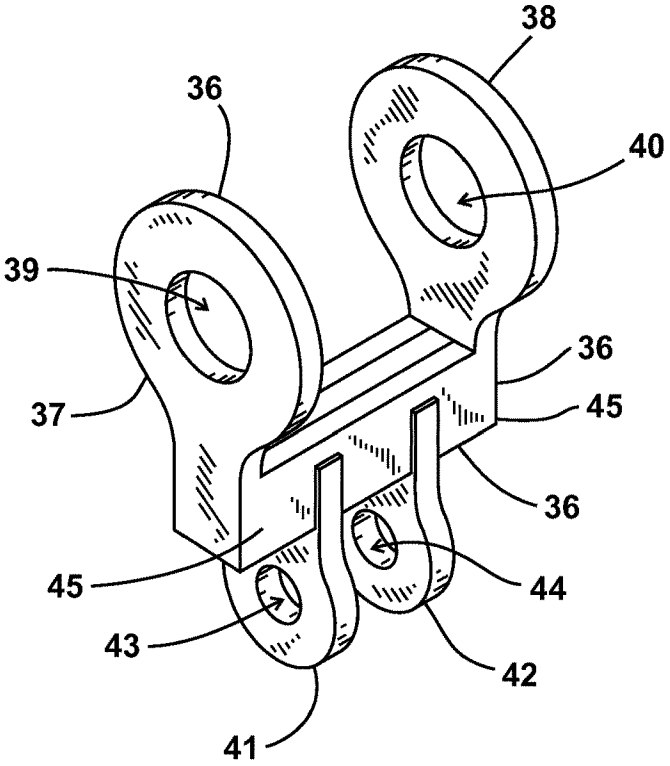
FIG. 5 is a fragmentary view of a preferred embodiment of the apparatus of the present apparatus showing a lower link.
Figure 4:
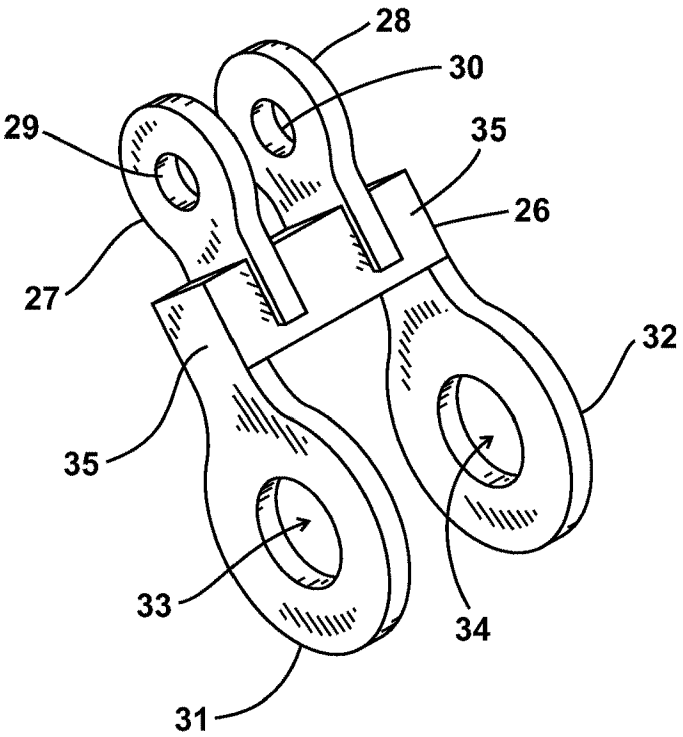
FIG. 4 is a fragmentary view of a preferred embodiment of the apparatus of the present apparatus showing an upper link.

Lower link 36 (FIG. 5) has a similar construction to upper link 26. The lower link 36 has larger upper plates 37, 38 and smaller lower plates 41, 42. Larger upper plate 37 has plate opening 39. Larger upper plate 38 has plate opening 40. Smaller lower plate 41 has plate opening 43. Smaller lower plate 42 has plate opening 44. Connecting portion 45 joins the larger upper plates 37, 38 and the smaller lower plates 41, 42 of the lower link 36. Connecting portion 45 can include multiple structural beams and/or plates welded together. Each link assembly 17, 18 thus preferably comprises a trunnion sleeve 20 as seen in FIG. 3, an upper link 26 as seen in FIG. 4 and a lower link 36 as seen in FIG. 5.

Figure 6:
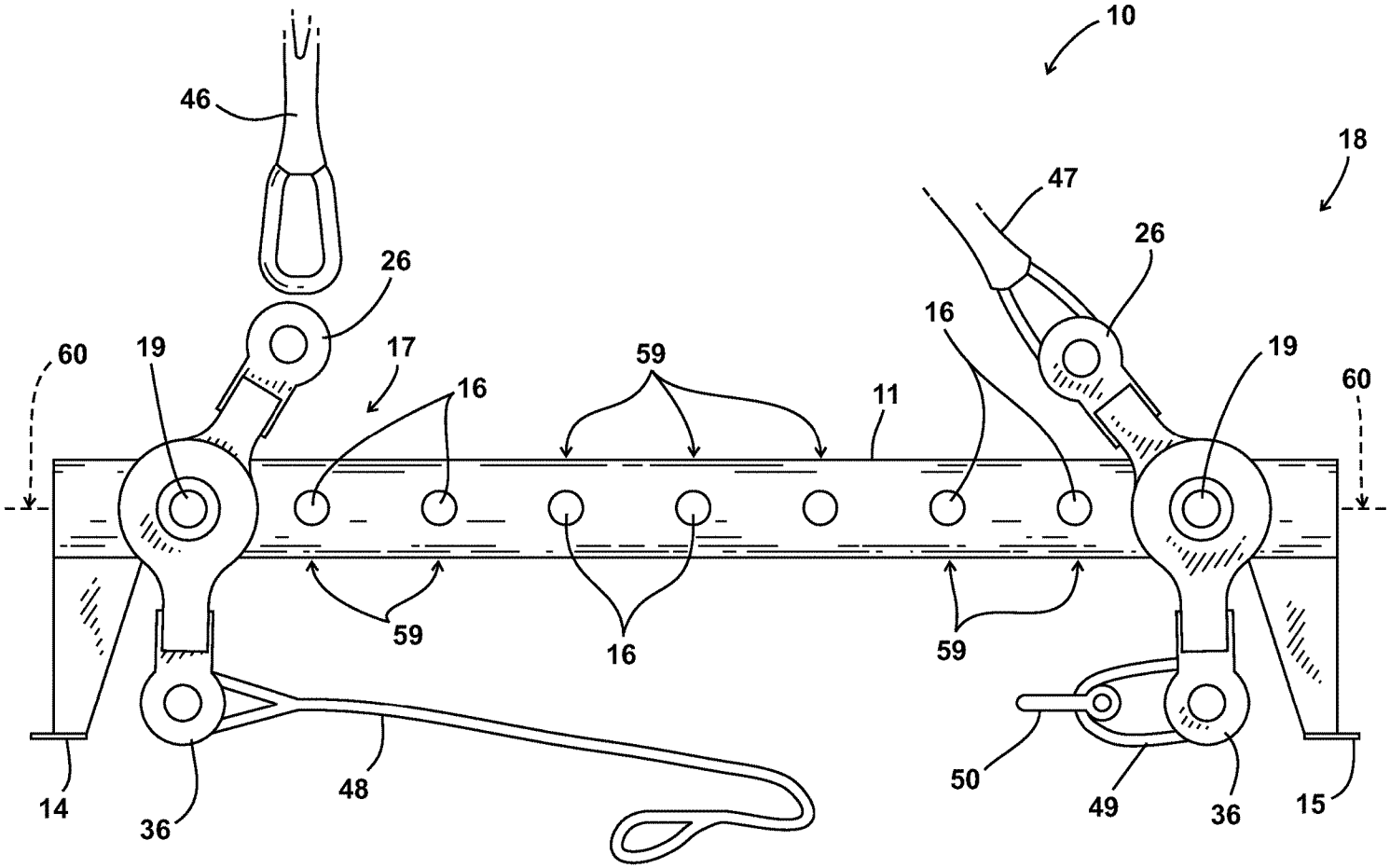
FIG. 6 is a perspective view of a preferred embodiment of the apparatus of the present invention.

FIG. 6 illustrates attachment of lifting lines and slings or grommets to bar apparatus 10. Lifting line 46 can attach to upper link 26 of link assembly 17. Similarly, a lifting line 47 can attach to upper link 26 of link assembly 18. The lifting lines 46, 47 can be attached to the lifting fitting (e.g., hook) of a lifting machine such as a crane. Slings or grommets can be attached to the lower links 36 of link assemblies 17, 18. In FIG. 6, sling 48 attaches to lower link 36 of link assembly 17. A grommet or sling 49 and a fitting (e.g., a shackle) 50 attached to the grommet 49 can then attach to lower link 36 of link assembly 18 (see FIG. 6). Pins, fittings or shackles or other rigging can be used to interface each lifting line 46, 47 with a link assembly 17, 18. Pins, fittings or shackles or other rigging can be used to interface each sling 48 or grommet 49 to a link assembly 17, 18.

FIG. 7 shows an alternate link assembly 51 having a trunnion sleeve 53 fitted with carriage 52 having rollers 54 which reduce friction when sliding the link assembly 51 from one pair of bore openings or holes 16 to the next pair of bore openings or holes 16 during adjustment. Upper link 55 and lower link 56 are pivotally attached to trunnion sleeve 53. As shown in FIG. 7 each upper and lower link 55, 56 is preferably fitted with a shackle 57 or 58.

FIGS. 8-12 show another alternate embodiment of the apparatus of the present invention, designated generally by the numeral 61. If FIGS. 8-12, adjustable spreader bar apparatus 61 provides link assemblies 62, 63. Each link assembly 62, 63 includes upper and lower links 64, 65. Upper link 64 (see FIGS. 9-11) has an opening 66 that is connectable to a lifting line 67 and crane 81. Lower link 65 provides an eyelet or padeye 68 having opening 69. Opening 69 enables a connection to a sling or other lifting line or cable or rigging (e.g., a shackle). Upper link 64 has plates 71, 72 that can include lower rounded portions having openings 79 that are receptive of a pin 19. Lower link 65 has plates 73, 74, 75, 76. Each plate 73, 74, 75, 76 has an opening 80. Notice in FIGS. 9 and 10 that the plate 71 of upper link 64 is positioned in between plates 73, 74 of lower link 65. Similarly, plate 72 of upper link 64 is in between plates 75, 76 of lower link 65. Plates 71, 72 are connected to body 77 of upper link 64. Similarly, plates 73, 74, 75, 76 are attached to body 78 of lower link 65. A pin 19 fits through plates 71, 72, and 73, 74, 75, 76 at openings 79, 80 as seen in FIGS. 8-12.

The following is a list of parts and materials suitable for use in the present invention:

PARTS LIST:

| PART NUMBER | DESCRIPTION |
|---|---|
| 10 | adjustable spreader bar apparatus |
| 11 | bar |
| 12 | bar end/bar end portion |
| 13 | bar end/bar end portion |
| 14 | foot |
| 15 | foot |
| 16 | bar opening/bore |
| 17 | first link assembly |
| 18 | second link assembly |
| 19 | pin |
| 20 | trunnion sleeve |
| 21 | first open ended bore |
| 22 | second open ended bore |
| 23 | larger diameter sleeve |
| 24 | smaller diameter sleeve |
| 25 | smaller diameter sleeve |
| 26 | upper link |
| 27 | smaller upper plate |
| 28 | smaller upper plate |
| 29 | plate opening |
| 30 | plate opening |
| 31 | larger lower plate |
| 32 | larger lower plate |
| 33 | plate opening |
| 34 | plate opening |
| 35 | connecting portion |
| 36 | lower link |
| 37 | larger upper plate |
| 38 | larger upper plate |
| 39 | plate opening |
| 40 | plate opening |
| 41 | smaller lower plate |
| 42 | smaller lower plate |
| 43 | plate opening |
| 44 | plate opening |
| 45 | connecting portion |
| 46 | lifting line |
| 47 | lifting line |
| 48 | sling |
| 49 | grommet/sling |
| 50 | shackle/fitting |
| 51 | link assembly |
| 52 | carriage |
| 53 | trunnion sleeve |
| 54 | roller |
| 55 | link |
| 56 | link |
| 57 | shackle |
| 58 | shackle |
| 59 | location/position/stop |
| 60 | bar central longitudinal axis |
| 61 | adjustable spreader bar apparatus |
| 62 | link assembly |
| 63 | link assembly |
| 64 | upper link |
| 65 | lower link |
| 66 | opening |
| 67 | sling/lift line |
| 68 | eyelet |
| 69 | opening |
| 71 | plate |
| 72 | plate |
| 73 | plate |
| 74 | plate |
| 75 | plate |
| 76 | plate |

-continued

| PARTS LIST: | |
|---|---|
| PART NUMBER | DESCRIPTION |
| 77 | body |
| 78 | body |
| 79 | opening |
| 80 | opening |
| 81 | crane/lifting device |

All measurements disclosed herein are at standard temperature and pressure, at sea level on Earth, unless indicated otherwise. All materials used or intended to be used in a human being are biocompatible, unless indicated otherwise.

The foregoing embodiments are presented by way of example only; the scope of the present invention is to be limited only by the following claims.

The invention claimed is:

1. A spreader bar apparatus, comprising:

a) a bar member having a bar length, first and second bar end portions, a bar outer surface in between said first and second bar end portions and a plurality of spaced apart stops between said first and second bar end portions;

b) a first link assembly providing a first lifting portion;

c) a second link assembly providing a second lifting portion;

d) the first link assembly being movable from one said stop of said plurality of spaced apart stops to another said stop of said plurality of spaced apart stops;

e) the second link assembly being movable from one of said stops to another of said stops;

f) multiple lifting lines that are attachable to the first and second link assemblies;

g) wherein each said first and second link assembly includes an upper link, a lower link, and a trunnion sleeve, wherein the trunnion sleeve has a bore that is receptive of the bar member, and wherein the upper and lower links are rotatably mounted to the trunnion sleeve;

h) wherein the trunnion sleeve bore of each of the first and second link assemblies is sized and shaped to fit over the bar outer surface; and i) wherein the first and second link assemblies are each comprised of an upper link having an upper link opening, a lower link having a lower link opening and a pin that extends through both upper and lower link openings and through a selected stop.

2. The spreader bar apparatus of claim 1 wherein the first link assembly is pivotal relative to the second link assembly.

3. The spreader bar apparatus of claim 1 wherein each trunnion sleeve has a sleeve transverse opening and said pins each provide a pinned connection that enables a connection of each trunnion sleeve to a selected stop, each said pinned connection including one of said pins that extends through both a trunnion sleeve transverse opening and a selected stop.

4. The spreader bar apparatus of claim 1 wherein each said upper link has an opening that defines a lift line attachment.

5. The spreader bar apparatus of claim 1 wherein each said lower link has an opening that defines a lift line attachment.

6. The spreader bar apparatus of claim 1 wherein a pinned connection connects each trunnion sleeve to the bar member at a selected stop and connects each said upper and lower link assemblies to said trunnion sleeve.

7. The spreader bar apparatus of claim 1 wherein the lower link has an opening that is connectable to a lift line.

8. The spreader bar apparatus of claim 1 wherein a common pinned connection joins a lift line link member and a trunnion.

9. The spreader bar apparatus of claim 1 wherein the plurality of stops include spaced apart bar openings.

10. The spreader bar apparatus of claim 9 wherein the plurality of stops are pairs of aligned openings.

11. A spreader bar apparatus, comprising:

a) a bar member having a bar length and first and second bar end portions and a plurality of transverse bar openings spaced between said first and second bar end portions;

b) a first bar lifting portion that is slidably movable relative to the bar member;

c) a second bar lifting portion that is slidably movable relative to the bar member;

d) the first and the second bar lifting portions being movable from one of said bar openings to another of said bar openings;

e) one or more lifting lines that are each attachable to the first or second bar lifting portions;

wherein each of the first and second bar lifting portions includes an upper link, a lower link, and a trunnion sleeve, wherein the trunnion sleeve has a bore that is sized and shaped to receive the bar member, wherein the upper and lower links are rotatably mounted to the trunnion sleeve; and g) one or more pins that enable the trunnion sleeve to be attached to the bar member at a selected bar opening.

12. The spreader bar apparatus of claim 11 wherein each upper link is pivotal relative to a lower link.

13. The spreader bar apparatus of claim 11 wherein the pin defines a pinned connection that joins each trunnion sleeve to a selected opening.

14. The spreader bar apparatus of claim 13 wherein the pinned connection connects each trunnion sleeve to the bar at a selected opening and the pin connects to each said upper and lower link.

15. The spreader bar apparatus of claim 11 wherein the upper link has an opening that defines a lift line attachment.

16. The spreader bar apparatus of claim 11 wherein the lower link has an opening that defines a lift line attachment.

17. The spreader bar apparatus of claim 11 wherein the lower link has an opening that is connectable to a lift line.

18. The spreader bar apparatus of claim 11 wherein the pin defines a common pinned connection that joins a said lift line link member and a said trunnion sleeve.

19. The spreader bar apparatus of claim 11 wherein the bar openings include a pair of horizontally aligned openings that are each equidistant from a said bar end portion.

20. The spreader bar apparatus of claim 11 wherein the bar openings are pairs of aligned openings.

21. A spreader bar apparatus, comprising:

a) a bar member having a bar length, first and second bar end portions, and a plurality of transverse bar spaced apart openings in between said first and second bar end portions;

b) a first bar lifting portion that is slidably movable upon the bar member;

c) a second bar lifting portion that is slidably movable upon the bar member;

d) the first and the second bar lifting portions being movable from one of said spaced apart bar openings to another of said spaced apart bar openings;

e) lifting lines that are each attachable to a first or second bar lifting portion;

f) wherein each of the first and second bar lifting portions includes an upper link having an upper link opening, a lower link having a lower link opening that is aligned with the upper link opening and a pin that extends through said aligned upper and lower link openings; and g) wherein said pin of each of the first and second bar lifting portions enables the upper and lower links to be attached to said bar member at a selected bar opening by insertion of the pin through said aligned upper and lower link openings and through a selected said bar opening.

22. The spreader bar apparatus of claim 21 wherein each upper link is pivotal relative to a lower link about a common pivot.

23. The spreader bar apparatus of claim 21 wherein the upper link has an opening that defines a lift line attachment.

24. The spreader bar apparatus of claim 21 wherein the lower link has an opening that defines a lift line attachment.

25. The spreader bar apparatus of claim 24 wherein each pin provides a pinned connection which defines a common pivot axis.

26. The spreader bar apparatus of claim 21 wherein the lower link has an opening that is connectable to a lift line.

27. The spreader bar apparatus of claim 21 wherein the bar openings include a pair of horizontally aligned openings that are each equidistant from a said bar end portion.

28. The spreader bar apparatus of claim 21 wherein the bar openings are pairs of aligned openings.

* * * * *